United States Patent [19]

Karlin et al.

[11] 4,283,049

[45] Aug. 11, 1981

[54] BOWLING BALL GAME

[75] Inventors: Richard A. Karlin, Chicago; Gordon A. Barlow, Evanston; John R. Krutsch, Glenview, all of Ill.

[73] Assignee: Gordon Barlow Design, Ill.

[21] Appl. No.: 9,762

[22] Filed: Feb. 7, 1979

[51] Int. Cl.[3] ..... A63D 3/00

[52] U.S. Cl. ..... 273/38; 273/85 G; 273/41

[58] Field of Search ..... 273/37, 41, 54 C, 85 G, 273/38, 138 A

[56] References Cited

U.S. PATENT DOCUMENTS

| | | | |
|---|---|---|---|
| 2,523,257 | 9/1950 | Firestone | 273/41 X |
| 2,643,884 | 6/1953 | Koci | 273/54 C UX |
| 2,652,252 | 9/1953 | Alexander | 273/54 C UX |
| 3,703,288 | 11/1972 | Vogel et al. | 273/41 |
| 4,008,893 | 2/1977 | Yoseloff | 273/37 X |

OTHER PUBLICATIONS

Bally Alley © Service Manual No. F.0.443, Game No. 966, Wall Bowler.

*Primary Examiner*—Anton O. Oechsle
*Attorney, Agent, or Firm*—Alter and Weiss

[57] ABSTRACT

A miniaturized bowling ball game comprising a simulated lane assembly having an automatic pin status indication, a scoring readout device and a noise generator operated responsive to a ball propelled over the lane assembly by an aimable shooter striking operating contacts simulating the ball striking and knocking down pins. The scoring read out device not only provides the score, but also the frame, and indicates if the prior frame resulted in a spare or strike. Electronically generated noises simulate the noises that occur when pins are knocked down in an actual bowling ball game. Also, the electronic controls randomly provides data which results in different scores, even though balls traverse the same routes.

9 Claims, 8 Drawing Figures

BOWLING BALL GAME

This invention is concerned with miniaturized action games; and more particularly, with miniaturized simulated bowling games.

Presently there is a great deal of interest in miniaturized simulated games. For example, there are many miniaturized simulated games using the TV screen of the home TV receiver. There are also miniaturized games available which simulate popular action games and do not use the TV screen. There are miniaturized simulated hockey games, football games and bowling alleys.

In the available miniaturized simulated games, the player manipulates figures representing actual hockey players or football players. In the miniaturized bowling ball games that are presently available, missiles are released and used to knock down miniature pins analogously to actual bowling games. The miniaturized bowling games presently also have automatic pin setters, game scorers, along with noise generators.

However, the simulated games presently available are relatively large and clumsy. The pins, in many cases, are loose and thus easily lost. However, the simulated bowling games presently available lack, among other things, a random displacement of pins pursuant to being struck by the bowling ball.

In the actual bowling games as played in the full sized alleys, the actual falling of the pins is unpredictable. Factors such as the speed of the ball, spin of the ball and the precise position of the pins vary the falling patterns in conjunction with the position of the ball during its travel through the pins. Thus, it often occurs that even though the ball hits the "pocket" a strike nonetheless does not occur; or, the ball can strike outside of the "pocket" and yet a strike does occur. Until now, such unpredictable action of the pins has not been a part of the simulated miniaturized bowling ball games.

This machination of the pins on a relatively random basis has especially not been found in the prior art in miniaturized games that have used simulated pins.

Accordingly, an object of the present invention is to provide simulated miniaturized bowling ball games.

A related object of the present invention is to provide simulated bowling ball games not using any pins, but still being scored as a function of the position of the ball as it traverses the alley.

Yet another object of the present invention is to provide miniaturized bowling ball games wherein the pins are represented by independent light projecting or reflecting electronic devices which are switched to indicate when the projected missile has knocked down the pin represented by the electronic device.

Yet another object of the present invention is to provide rotatable aimers enabling projecting a missile or a ball towards the simulated target.

Yet another object of the present invention is to provide automatic means for scoring the game and for generating noises which audibly indicate the degrees of success the player had with his turn.

Another object of the present invention enables selection between two players and one player participating in the game and for automatically scoring the game in accordance with the selection.

Yet another object of the present invention is to provide for a readout of the frame and bonus points earned by the player operating the aimer.

Yet another object of the present invention is to provide means for indicating the position of the ball where the pins would be without the actual use of pins.

A preferred embodiment of the present invention comprises a miniaturized lane assembly. One end of the lane assembly is equipped with an aiming and shooting device for propelling a ball towards the other end of the lane. The other end of the lane contains the means for determining the positions of the ball as it passes through the zone where the pins would be if there were pins. The positions of the ball are determined by a unique switching arrangement comprising downwardly depending finger-like switch armatures traversing the width of the lane including the gutters.

When the ball impinges on the fingers, it causes a momentary closing of switches. If the ball impinges on more than one finger, more than one switch is closed. Microprocessor means are used to determine which of the fingers close, thereby determining the location of the ball. That information is used to determine and indicate which pins were knocked down.

The microprocessor includes memory means used to program the processor to indicate certain pins knocked down by the ball as a function of the location of the ball in the pin zones.

Bits are randomly inserted into the program for knocking down different pins at different times, even though the ball strikes the same downwardly depending fingers.

The micro-processor means, in addition to providing the intelligence to indicate which pins have been knocked down by switching off certain electronic indicating devices, such as ten LEDs arranged geometrically also automatically indicates the score, the frame and the bonus condition of each ball.

A noise simulator produces noises responsive to the success or failure of the propelled ball. The noise simulator also provides audio indication of game condition. The loud speaker and batteries are contained in a box electrically coupled to the lane assembly of the bowling game.

These and other objects and features of the present invention will be best understood by making reference to the accompanying copy of the drawings, wherein.

Figure 6:
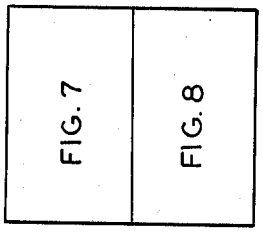
Figure 7:
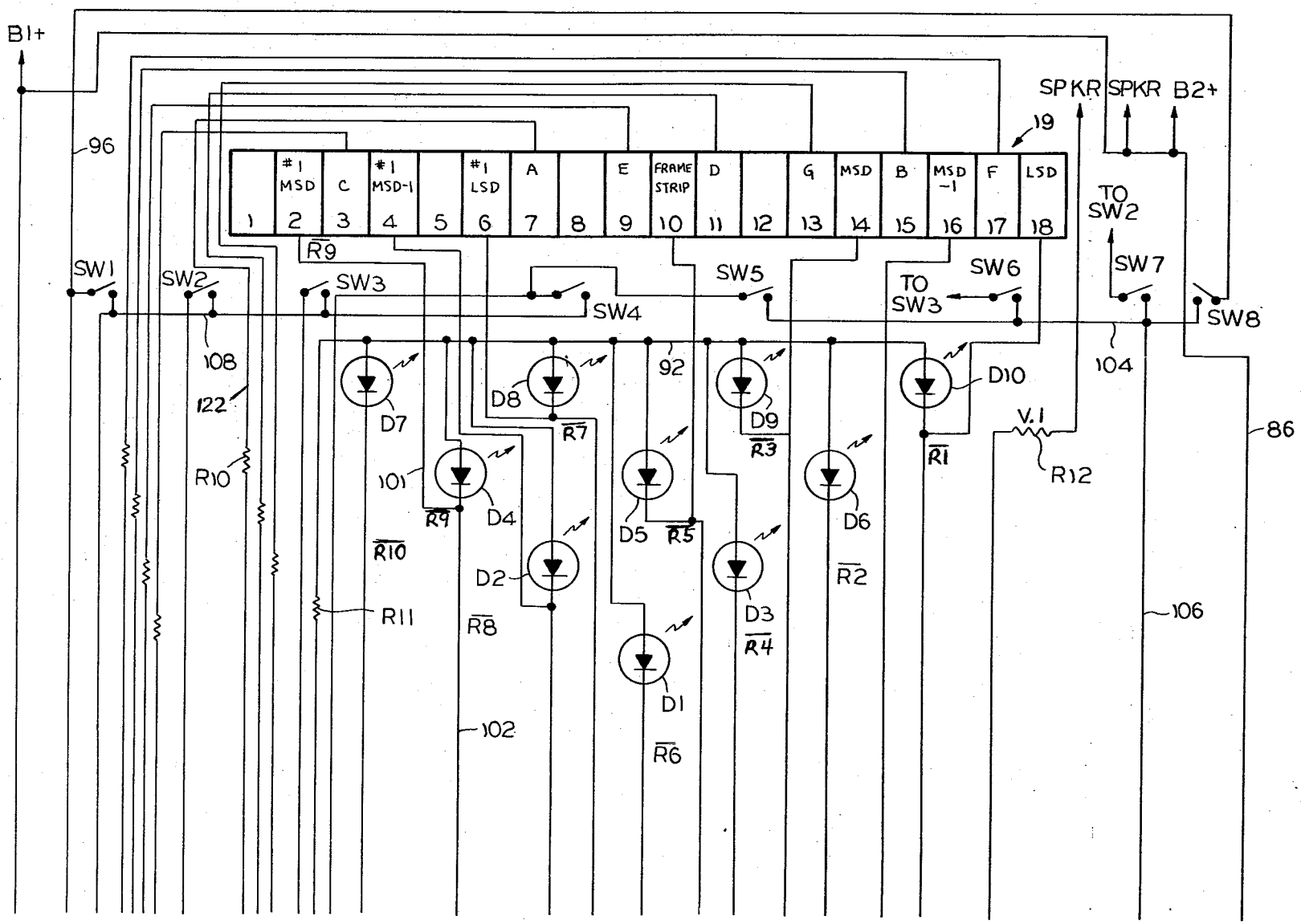
Figure 8:
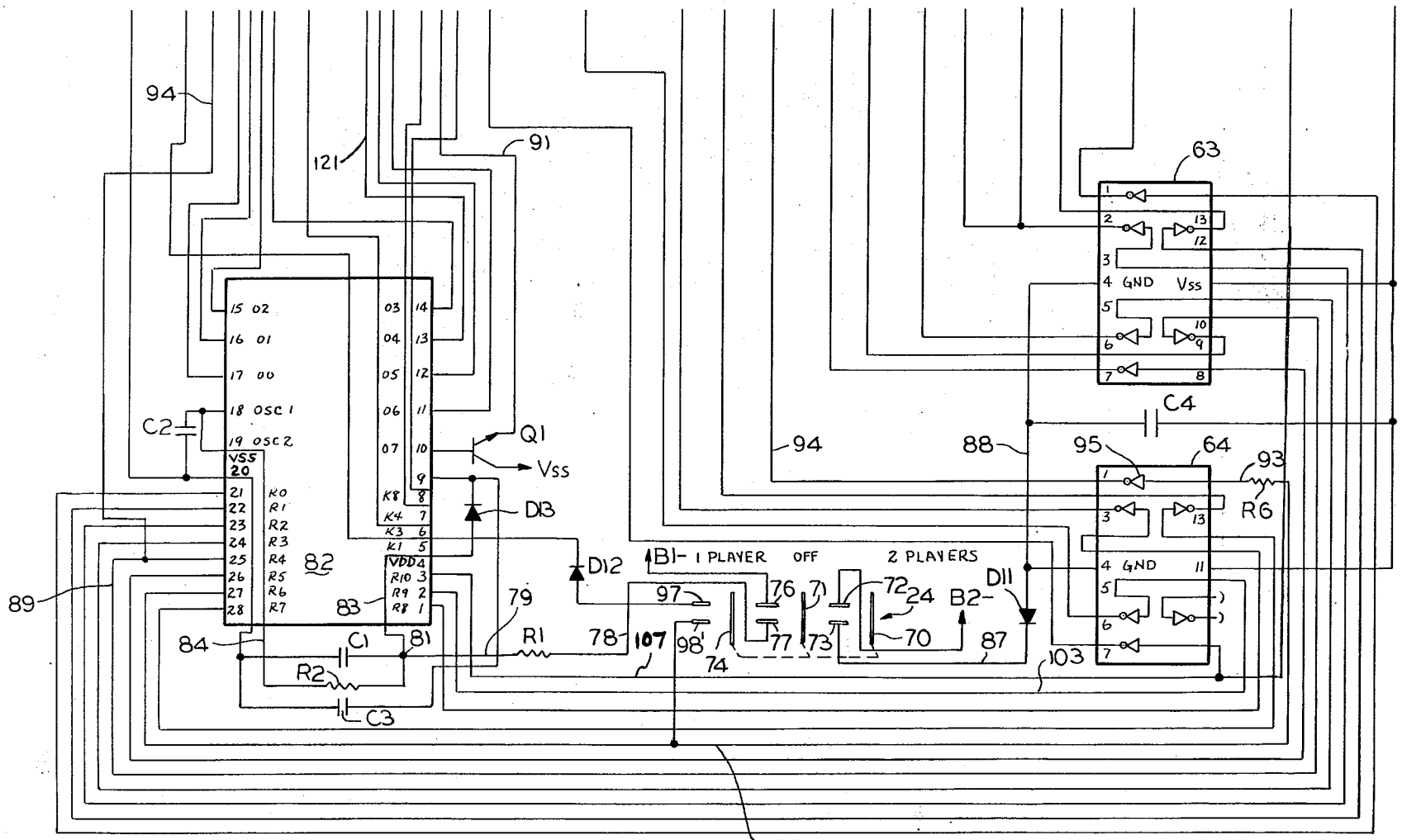

FIG. 6 indicates how FIGS. 7 and 8 are joined; and

FIGS. 7 and 8 are the schematic showings of electronics used in an embodiment of the bowling ball game.

The bowling game 11 comprises a lane assembly 12 mountable on a horizontal surface, such as a table. The lane assembly includes a lane portion 13 separating an aiming and shooting section 14 from the pin simulator and scoring section 16. The lane, and the pin simulator and scoring section are covered by a transparent plastic cover 17. The pin simulator and scoring section 16 includes an array of light projecting diodes arranged in the geometric triangle in which bowling pins are normally arranged. This is shown at 18 wherein an array of ten LEDs are indicated. It should be understood that while LEDs are described in conjunction with this game, other electrical or electronic indicating devices could also be used by those skilled in the art, based on the teachings herein.

Means are provided for indicating the score. More particularly, a "stick" of light emitting diodes is shown at 19. As shown therein there are three groups of LEDs—a first group 21 made up of three seven segment diodes, a second group 22 made up of a single seven segment diode, and a third group 23 also made up of three seven segment diodes. These diodes are the well known seven segment arrangements used in calculators, for example, for indicating numbers from 0 through 9.

Means are provided for turning the game on and off and for selecting whether one or two players are to participate in the game. More particularly, switch means 24 is used for making the selection and turning the game on and off.

The lane 13 includes a gutter at each side, such as gutters 26 and 27 shown at both sides of the lane. The lane assembly 12, when set on a horizontal surface, holds lane 13 biased towards the aiming and firing section so that a ball propelled towards the pin simulator and scoring section is returned to the aiming and shooting section by the force of gravity.

Figure 1:
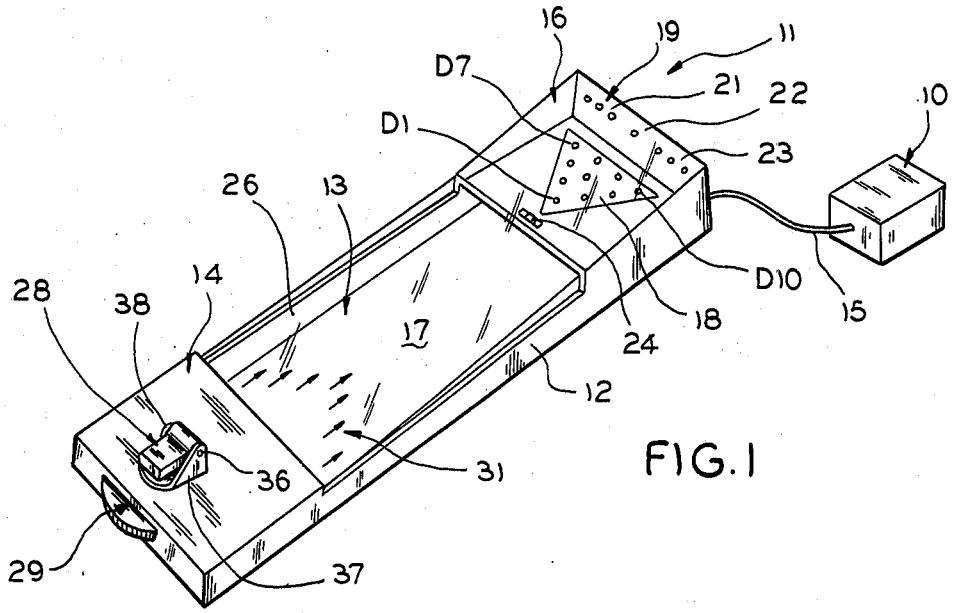
FIG. 1 is a pictorial representation of the bowling game.

The aiming and firing section 14 includes a projectile firing assembly 28 which includes aimer 29. As can be seen in FIG. 1, in particular, there are spotting arrows 31 on lane 13 such as those normally found in the regular sized bowling alleys. The spotting arrows aid in aiming the ball to obtain strikes and spares.

Figure 2:
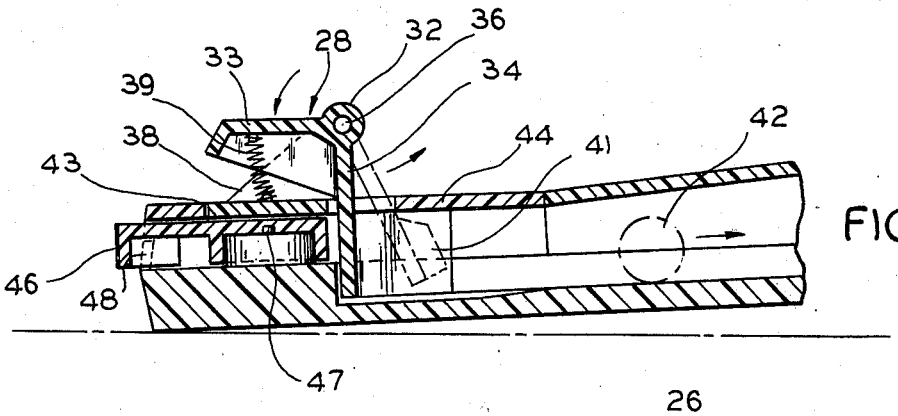
FIG. 2 is a partial sectional view of the aiming and shooting section of the lane assembly of the bowling ball game.
Figure 3:
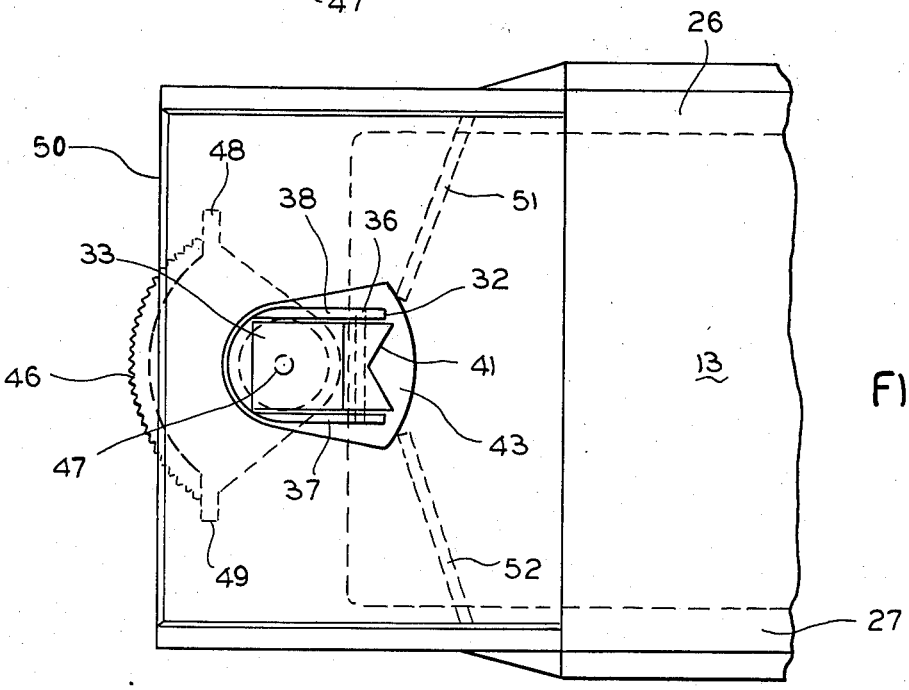
FIG. 3 is a plan view of the aiming and shooting section of the lane assembly of the bowling ball game.

As best seen in FIGS. 2 and 3, the aiming and shooting assembly 28 comprises a spring loaded L-shaped ball shooting device having a pivot section 32, a substantially horizontal section 33 and a substantially vertical section 34. The pivot section pivots around a pin 36, held between a pair of oppositely disposed spaced apart flange members 37 and 38. A coil spring 39 normally maintains the L-shaped shooter with section 33 substantially horizontal and section 34 substantially vertical.

The player applies sudden pressure to section 33 with his finger, which causes the vertical section 34 to move on an arc, the vertical section 34 has a V-shaped bottom 41 designed to cradle a spherical projectile, such as ball 42. The sudden movement of the vertical section propels the ball toward the other end of the lane. The aiming and firing device 28 is located in aperture 43 in the top non-transparent surface 44 of section 14.

The aiming means 29 provided for aiming the ball 42 includes arcuate turntable-like aiming member 46, shown with knurled edges 53. The arcuate aiming member 46 is rotatable around axis 47. Thus, when member 46 is manipulated by the user, the direction in which the ball is launched can be varied over the arc including gutters 26 and 27. The user soon learns to use the spotting arrows 31 to successfully aim the ball 42 by manipulating the arcuate turntable member 46.

The arcuate turntable member 46 terminates in two outwardly extending oppositely disposed limiting members 48 and 49 which limit the travel of arcuate member 46 by abutting the back surface 50 of section 14 on the lane assembly 12. The shooting device 28 is mounted to the arcuate member 46 in any well known manner.

The lane 13 terminates at the aiming and shooting section in bulkheads 51 and 52 each shown extending from the gutters 26 and 27 slantingly toward the bottom 41 of the shooting device to assure that when the ball is returned by gravity it is directed to the characterized "V" 41 at the bottom of the shooting device.

Figure 5:
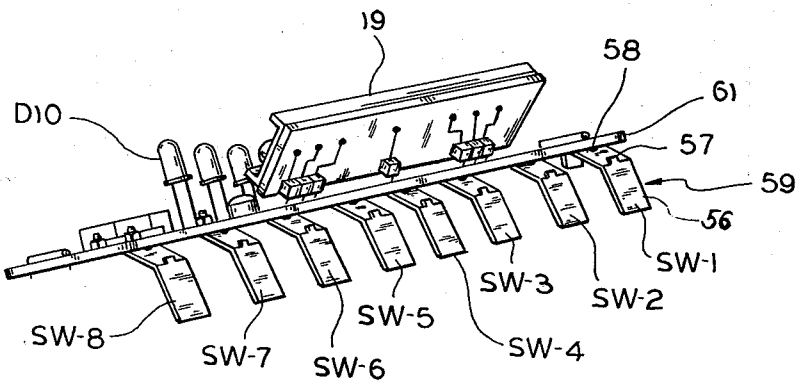
FIG. 5 is a pictorial view of the rear of the printed circuit board particularly showing finger switches.
Figure 4:
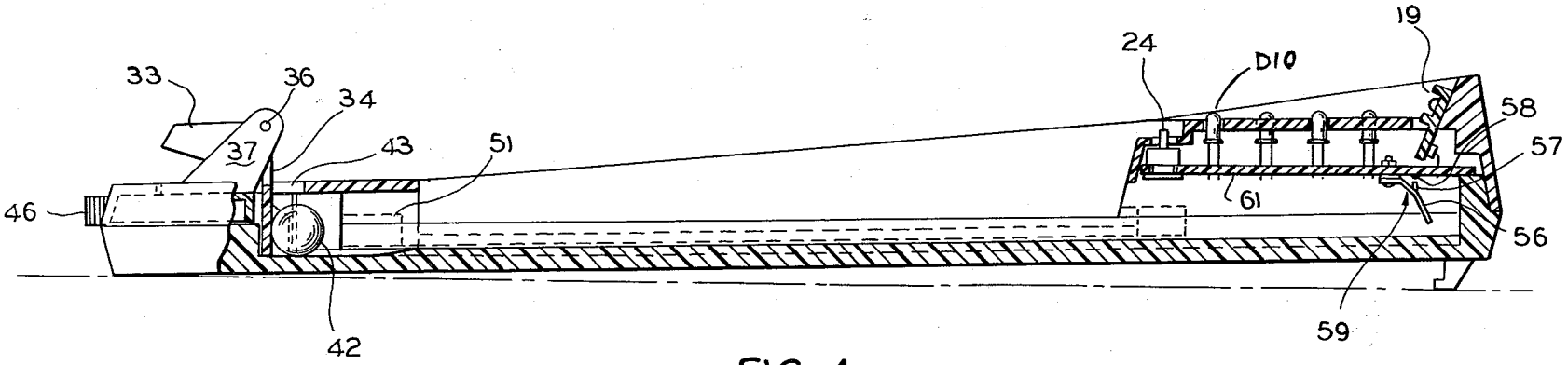
FIG. 4 is a sectional side view of the bowling ball game showing a printed circuit board mounted in place.

The finger switches 59 are shown in FIGS. 4 and 5. For example, the finger armature 56 is shown in FIG. 5. When fingers, such as finger 56 is struck by the ball, it causes a point 57 on the top side of the finger to momentarily strike a conductive pad 58 on the board 61. The abutting of the point and pad momentarily close a circuit made by the connections to the finger strip and the connections to the pad 58.

The position of the ball is determined by which fingers the ball strikes. The micro-processor uses this information plus randomly inserted bits to determine how many pins are knocked down by the ball.

The printed circuit board 61, shown unmounted in FIG. 5 and mounted in FIG. 4, is used for mounting the individual LEDs depicting the pins, such as for example LED D10 and for mounting the score indicating LED strip 19. In addition, the printed circuit board also has mounted thereon the micro-processor, the integrated circuits 63 and 64, shown schematically in FIGS. 7 and 8, and the switch 24 used for selecting the one player or two player mode of operation.

The finger switches 59, complete a circuit to the micro-processor responsive to being struck by the propelled ball. The fingers 59 represent individual switches indicated on the schematics and in FIG. 5 as switch SW1 and switch SW8 with the remaining switches in chronological order therebetween.

In FIGS. 7 and 8, it is seen that when the on-off player select switch 24 is in the middle position, no power is connected and the game is in the off condition.

When switch 24 is moved to the left, then shorting bar 74 connects pads 97, 98, 76, 77 and 72, 73. The interconnection of pads 97, 98 bring a definitive positive signal from terminal 29 to terminal 5 through diode D12 of the micro-processor 82. The definitive signal indicates to the micro-processor that the single play made is operative. When the switch 24 is moved to the right, the microprocessor is alerted that the two player mode is operative. The shorting bar 71 connects pads 72 and 73 of the printed circuit board thereby connecting battery B2− through conductor 87, diode D11 and conductor 88 to provide the low or ground voltage to integrated circuit boards 63 and 64. As indicated in FIG. 8, integrated printed circuit boards 63 and 64 contain buffer inverter amplifiers. A high is coupled to the printed circuit boards from B+ voltage over conductor 86. A filter capacitor C4 is connected between conductors 86 and 88. At the same time, shorting bar 74 connects together pads 76 and 77. Pad 76 is connected to the battery B1−. Pad 77 is connected through conductor 78, resistor R1, conductor 79 to junction point 81 below the micro-processor 82.

The junction point 81 is connected to terminal 5 of the micro-processor 82 over conductor 83. The junction 81 is also connected through resistor R2 and conductor 84 to the timing or oscillator terminal 19 of the micro-processor 82. The time position of the oscillator is established by the values of resistor R2 and capacitor C2 which is connected between terminals 18 and 19 coupled together and terminal 20 of the micro-processor. Terminal 20 of the micro-processor is also connected to the positive terminal of the B1 battery over conductor 89 and the junction 81 through filter capacitor C1.

At the initiation of the game a positive signal is transmitted at terminal 10 to the base of a driving NPN transistor Q1. The collector of the transistor is connected to supply voltage VSS. The emitter of the transistor is connected through conductor 91, dropping resistor R11 to bus 92, which provides positive voltage to the anode of all of the discrete diodes D1 through D10.

The cathodes of each of the diodes are energized under the control of the micro-processor. More particularly, the cathodes are individually connected to inverter outputs of the printed circuit boards 63 and 64. For example, the cathode of LED diode D1 is connected to terminal 1 of the printed circuit board 64 through conductor 92. As is shown in FIG. 8, terminal 1 is the output of an inverter buffer amplifier whose input is coupled through conductor 93 to terminal 27 of the micro-processor. Terminal 27 of the micro-processor provides a high signal R6. Accordingly, the signal on conductor 92 is the low signal R6.

In a similar manner the terminals 1, 2, 3 and 22 through 28 of the micro-processor are coupled to inverter amplifiers on the printed circuit boards 63 and 64. The outputs of the inverter amplifier are negative signals which are connected to cathodes of the remaining LED diodes D2–D10.

When the switch 24 is switched to the on position such as in the two player position, then the micro-processor automatically tests and sets itself and the system. For example, tests are performed to check the operation of the memory, the LED stick, the discrete LEDs, the inputs to the micro-processor and the sound system. If a tested unit is not good, a "missed" tone sounds. If the unit is good, no tone sounds and the micro-processor automatically sets the "beginning of game" condition.

The "beginning of game" condition finds the individual LEDs representing the pins all lit indicating that the pins are standing. Also, the score indications on the LED strip are all at zero if the two players mode is initiated. When the one player mode is used, the left LEDs of the strip indicate zero, the right LEDs would not be energized at all. The frame strip shows a 1.

The switches 59 are all in the normal open condition. To energize the discrete LEDs, the micro-processor 82 provides a positive signal at its terminal 10 causing NPN transistor Q1 to conduct. With transistor Q1 conducting, a high positive voltage VSS is connected through conductor 91 and resistor R11 to bus 92 and to the anodes of each of the individual pin simulating LEDs D1 through D10. A negative voltage is supplied to the cathode of each of the LEDs from the micro-processor and the inverter amplifiers of cards 63 and 64, as previously described.

Each player's score contains a most significant digit (MSD), a most significant digit less one (MSD-1), and a least significant digit (LSD), as indicated by blocks 2, 4 and 6, respectively, for Player #1 and blocks 14, 16 and 18, respectively, for Player #2. The seven elements of the LEDs on the strip are indicated by the A, B, C, D, E, F, G blocks on strip 19. The most significant digit of Player #1 in block #2 is supplied negative voltage to enable each of the segments over a path that includes conductors 101, 102, to terminal 6 of board 64 which is the output of an inverter amplifier connected through conductor 103 to terminal 2 of micro-processor 82. Terminal 2 provides a positive signal initially.

The "beginning of the game" condition is with segments A, B, C, D, E and F of the most significant digit, the most significant digit less one and the least significant digit of Players #1 and #2 all operated. This will give three Os for each of the Players. The "A" segment, for example, is coupled to the positive output 04 at terminal 13 of the micro-processor 82 over a circuit that includes conductor 121, brightness resistor R10 and conductor 122.

The frame indication has the B and C segments operated, providing a 1, since this is frame 1 for Player #1. The frame and bonus score indications are multiplexed, so that the frame strip block shows first a 1; i.e., the B and C segments operated and then a blank with none of the segments operated, since at this time there are no bonus scores.

The player at this time operates the aiming and shooting device 28 to propel the ball 42 down the lane 13. If the ball does not have sufficient momentum to reach the finger switches 59, the ball merely falls back to the aiming and shooting device; no score is made, and no discrete LEDs are switched to the off condition. If the propelled ball is a gutter ball, in hits switch SW8 or switch SW1.

The micro-processor detects the closing of any of the switches. For example, it detects the closing of switches on the right hand side, when it reads the voltage output of terminal 3 which is connected to bus bar 104 through which the four right hand switches SW5–SW8 are coupled. Bus bar 104 connects to terminal 3 over a path that includes conductors 106 and 107.

The switches SW1–SW4 on the left hand side connect to bus bar 108 which is coupled to terminal 25 over conductors 94 and 89. The closing of left hand side switches brings the voltage of terminal 25 to the terminal of the processor that is connected to the pad on the board contacted by the finger of the switch responsive to impingement by the bowling ball.

The closure of switch SW1 or switch SW8, for example, transmits a positive signal, that is normally provided at terminal 25 over conductors 89 and 94 through switch SW1 to conductor 96. Conductor 96 is connected to input K1 at terminal 5 of micro-processor 82. Input K1 is also connected through diode D12 to unconnected pad 97 of the on-off switch 24. The R4 signal is connected to the uncoupled pad and there is no reaction. Thus, the first player's score remains at "0"; the frame number remains at "1" and the second player's score remains at "0".

It should be understood that each of the seven segmented digits of the LED sticks are energized on a multiplex basis. Thus, the first player's score is delivered during a first time sequence; the frame and bonus score LED segments are delivered during a second time frame; while the second player's score is delivered during a third time frame. The discrete LEDs are energized during a fourth time frame. The time frames occur at a repetition rate fast enough so that the LEDs seem to be energized continuously.

When the on-off switch 24 is first turned on, all of the discrete LEDs light up during the time sequence, and the first player's score is indicated as "8 8 8"; the frame and bonus score LEDs are indicated as "8"; and the second player's score is indicated as "8 8 8". This automatically tests all of the segments of the seven segmented digits. Shortly thereafter all the numbers indicate "0", which means that each of the line segments, except the G segment, has a positive signal thereon.

The frame and bonus score LED indication is a "1" which means that only the B and C segments are energized during the time sequence of that digit indication.

More particularly, during the time that terminal 26 of the micro-processor is providing a positive signal, a negative signal is provided to block 10 of the LED stick. During alternate time frames, when this negative signal is applied, the B and C segments are energized indicating frame "1".

On alternate time frames of the cathode at block 11, the B and C segments are also energized indicating a bonus multiplier of "1"; i.e., no spares or strikes made by the previous balls.

Assuming the first ball is a gutter ball, then the ball strikes the finger operating switch 1 or the finger operating switch 8. The micro-processor detects the closing of switch 1, when it momentarily receives the R2 voltage at terminal 5. The switch 8 closing is indicated to the micro-processor by the receipt of the R1 voltage, at terminal 5 of micro-processor 82.

Responsive to the receipt of either of those voltages at terminal 5, the micro-processor leaves all the discrete LEDs in the on condition, leaves the first player's score at "0", leaves the bonus at "1" and the frame at "1"; but retains in its memory the fact that the first player has used his first ball.

If the second ball is thrown and the fingers close switches 1 and 2, for example, the micro-processor is notified by the R2 voltage sensed at terminals 5 and 6. The micro-processor determines the hit zone from the switches that are closed and enters the following table according to the hit zone to process the pin action.

TABLE 1

| finger switch closed | ZONE # | PIN # | LOGIC |
|---|---|---|---|
| 1 | 0 | F | |
| 1 & 2 | 1 | 7 | F |
| | | F | |
| 2 | 2 | 8 | F |
| | | 7 | C |
| | | 4 | F |
| | | 9 | 3 |
| | | F | |
| 2 & 3 | 3 | 4 | F |
| | | 8 | 5 |
| | | 7 | 5 |
| | | F | |
| 3 | 4 | 8 | F |
| | | 4 | F |
| | | 7 | 4 |
| | | 2 | F |
| | | 5 | 5 |
| | | 9 | 6 |
| | | 10 | 4 |
| | | F | |
| 3 & 4 | 5 | 8 | F |
| | | 2 | F |
| | | 4 | F |
| | | 7 | 5 |
| | | 5 | 6 |
| | | 9 | 6 |
| | | 6 | 6 |
| | | 10 | 5 |
| | | F | |
| 4 | 6 | 8 | F |
| | | 9 | F |
| | | 5 | F |
| | | 2 | F |
| | | 4 | F |
| | | 1 | F |
| | | 3 | 7 |
| | | 6 | 7 |
| | | 10 | 7 |
| | | 7 | F |
| | | F | |
| 4 & 5 | 7 | 9 | F |
| | | 8 | F |

TABLE 1-continued

| finger switch closed | ZONE # | PIN # | LOGIC |
|---|---|---|---|
| | | 5 | F |
| | | 1 | F |
| | | 3 | 7 |
| | | 2 | 6 |
| | | 6 | 5 |
| | | 4 | 4 |
| | | 10 | 1 |
| | | 7 | 0 |
| | | F | |
| 5 | 8 | 9 | F |
| | | 8 | F |
| | | 5 | F |
| | | 3 | F |
| | | 6 | F |
| | | 1 | F |
| | | 2 | 7 |
| | | 4 | 7 |
| | | 7 | 7 |
| | | 10 | F |
| | | F | |
| 5 & 6 | 9 | 9 | F |
| | | 3 | F |
| | | 6 | F |
| | | 10 | 5 |
| | | 5 | 6 |
| | | 8 | 6 |
| | | 4 | 6 |
| | | 7 | 5 |
| | | F | |
| 6 | 10 | 9 | F |
| | | 6 | F |
| | | 10 | 4 |
| | | 3 | F |
| | | 5 | 4 |
| | | 8 | 4 |
| | | 7 | 2 |
| | | F | |
| 6 & 7 | 11 | 6 | F |
| | | 9 | 5 |
| | | 10 | 5 |
| | | F | |
| 7 | 12 | 9 | F |
| | | 10 | 6 |
| | | 6 | F |
| | | 8 | 3 |
| | | F | |
| 7 & 8 | 13 | 10 | F |
| | | F | |
| 8 | 14 | 10 | F |
| | | F | |

The table is entered by the micro-processor via a "pointer" selected by the zone number. Note that each table line includes two nibbles—one nibble specifying the pin (0–10; 0001–1010); and the other nibble specifying the odds that the pin will fall from 0–7 (F), where 0 is "no chance" and F is a "sure thing". The odds nibble uses the first bit as a set string bit; that is, if it is a 1, the pin action is independent of any other pin; if it is a 0, the pin action is dependent on all previous pins being up and falling on this ball. For example:

| | | | |
|---|---|---|---|
| 1 | F | #1 | pin fall sure, no dependency |
| 2 | E | #2 | pin odds are 6/7, no dependency |
| 4 | 7 | #4 | pin sure, provided pin 7 present and falls |
| 7 | 6 | #7 | pin odds 6/7 provided pins 2 and 4 present & fell |
| 5 | D | #5 | pin odds 5/7, no dependency |
| 8 | 4 | #8 | pin odds 4/7 provided 5 present & fell |
| 9 | 4 | #9 | pin odds 4/7 provided 8 & 5 pins present & fell |

F(1111) End of Table section for this zone

The micro-processor computes the actual odds and determines if the pin falls by fetching the table line, taking the odds number, doubling the odds number, adding 2, adding a random nibble. If the total is equal to or greater than 16, the pin goes down.

In the tests, the sound system is tested by causing it to sound a "strike" tone. The finger switches are all tested to determine their status—they should all be open.

The frame numbers run from 0 through 9 with 0 indicating 10, and E indicating an extra frame. If there are no strikes or spares, then none of the segments are energized and the bonus digit is blank. When there has been a spare, segment D is energized. A strike causes the energization of segments D and G. If there are two strikes, then D, G and A are energized.

Premium multipliers are in accordance with the normal bowling game rule. If there is no strike or spare with the previous two balls, then the premium multiplier is 1. The premium multiplier for the ball after a strike or spare is 2. The premium multiplier for the ball after two successive strikes is 3.

At the end of the game, the frame number is blank. In frame number 11, that is the extra frame, the micro-processor is programmed to determine if the premium multiplier is equal to 1; then no extra balls are allowed. If the premium multiplier is equal to 2, and the last premium multiplier is equal to 1, only one ball is allowed. However, if the premium multiplier is equal to 2 and the last premium multiplier was equal to 2, then two balls are allowed. On the 11th frame, or the extra frame, the multiplier is reduced by 1 for the first ball.

It should be noted that the closure of the finger switches can be as brief as 2 milliseconds or as long as 50 milliseconds. If there are two closures, the time difference between the closures may be up to 50 milliseconds. Thus, the closure of the two switches may not necessarily overlap.

An input is provided by the closing of one or two of the normally open 8 input switches. If there are no inputs, the same digit is displayed which was displayed previously, unless it is the end of the game. If there is an indication of the end of the game, then the tone generator provides a "tick" sound approximately once a second.

The finger switches 59 are read into two separate banks—the left bank and the right bank. There are 8 scores representing the 8 switches. After reading the switches, the micro-processor seeks to determine if the "end of game score" is set. If it is, it performs new game housekeeping. If not, the micro-processor determines the hit zone from the input information.

The hit zone input information is tested to see if it is valid. For example, an input of zone 15 would be an invalid signal; and it would cause the micro-processor to return to the test of the inputs. The micro-processor, in effect, goes into the table in accordance with the zone indicated to process the pin action.

The processing in accordance with the table causes the micro-processor to end up with a new pin status; i.e., it counts the number of pins down; notes which pins remain up; then, if it's the first ball thrown, the micro-processor determines whether the pin down count is 0; i.e., a gutter ball. If it is, a "miss" tone is sounded and the micro-processor sets a ball #2 indication or flag. After ball #2 is thrown, once again, the micro-processor determines the pin down count; if it is 0, a "miss" tone is sounded. The new score is displayed and the "next player" tone is sounded.

If all of the pins are knocked down, then the pins which are knocked down are scored; the score is displayed; "pins knocked down" tones are sounded; and, after a delay, a "spare" tone is sounded, if applicable. If all the pins are not knocked down, then the micro-processor scores the pins that are knocked down; sounds the "pins knocked down" tone; then, after a delay, it sounds the "next player" tone.

Once again, it is noted that the pin number knocked down and the odds each consists of two nibbles; i.e., two 4-bit numerical indications. The pin numbers from 1 through 10 are indicated digitally from 0001 through 1010 by a first of the nibbles. A 1111 indication is an end flag for that zone. The odds are specified in the logic by the other nibble. The last three digits of the nibble are the odds with 0 meaning no chance; and a digital 7 indicating a sure thing. The first of the other nibble indicates dependency on other pins. Thus, binary 1 indicates "independent of any other pin" and a binary 0 indicates "dependency on previous pins".

As an example, the binary 10-7 indicates that pin 10 falls for sure. The micro-processor determines the pin number according to the zone number. If the nibble indicating the pin 1111, such as, for example, if a gutter ball is thrown, that is an indication of the end of the table section for the zone in use; and the micro-processor then goes to the next step of the process; which is, indicating the new pin status to the LED strip.

If the pin number is a 1111 at this time, then the micro-processor determines if the most significant bit; i.e., the leftmost bit of the logic is a 1. If it is not a 1, then the micro-processor adds 1 to the table pointer. Thus, for example, if the switches indicate zone 2, where pin 9 may be knocked down, if the "set string" bit digit at this point was a 0, then the process automatically goes to the next line of the table. If the "string flag" is set, or, if it was a 1 setting, then the micro-processor comes down and processes the other three bits of that four bit group.

The other three bits represent the odds—000, saying "no chance"; 111, saying "it's a sure thing". The three bits are doubled, in effect moving them to the topmost three positions, instead of the bottommost three positions. In other words, we shift left one place. We again test the string flag bit for 0. If it is a 0, a check is made to see if the specified pin is up. If it is up, the processor advances the pointer and looks at the next line. If it is not up, the "string flag" is reset. Thus, the 0 odds is used to manipulate the "string flag" so that, if the "string flag" test shows a 1, the next step is taken.

When the odds are greater than 0, a binary 2 and a random nibble are added. Once again, a test is made for 0. If the "string flag" is 0, a check is made to see if the pin is up. If the pin is not up, the "string flag" is reset and once again 1 is added to the table pointer; thus, going to the next line. If the pin is up, the "string flag" is not reset, but one is added to the table pointer.

If, when testing for 0, it is found that the bit is greater than 0, then a binary is added along with a random nibble. Then a test is made to see if a carry is created. If a carry is created, a test is made to see if the pin is up. If the pin is not up, the "string flag" is reset and one is added to the table pointer. If the pin is up, then the pin is put down and one is added to the pin down counter and to the table causing the pointer to go to the next line. The random is compared to the odds. If the random is higher than the odds, the pin is knocked down. Otherwise, the pin remains up. A failure to knock the pin down, or the absence of a pin because it was knocked down previously, resets the "string flag".

If the "string flag" is reset, no more pin knock downs are allowed. In other words, the string is broken. No more pins can fall until another line of the table sets the "string flag" back up. Thus, the table indicates the pin. If the logic is anything below a 7, then it is compared to a random number. If the random number is higher, the pin is knocked down. If the random number is lower, the pin, in effect, is left up and the next point in the table is entered until there is an "exit flag"; at which point the pins that are knocked down are counted and indicated.

There are different types of micro-processors which can be used. Some have the capability to scan the table line by line. Others first must read the whole section of the table, entering it into a scratch pad memory, then they scan the scratch pad memory a line at a time.

In some micro-processors a random number is obtained by adding 1 to a four bit counter everytime a digit is displayed. A four bit counter gives a read of 1–16. Adding a 1 everytime it reads is completely indeterminate and random.

The micro-processors which use this system suffer from the disadvantage in that when 1 is added to the table pointer and the next line of the table is read, the read is dependent on the first random. Other micro-processors solve this problem by merely creating a string of randoms; and then, when a ball causes a closure, a random from the string is selected and sometimes 1 is added to the random; sometimes 1 is subtracted from the random; sometimes 2 is added to the random; and sometimes 2 is subtracted from the random.

More particularly, the micro-processor contains counters which provide the display. Thus, there is a base counter for displaying the score and a blank counter for displaying either the frame or the current player's strike or spare bonus status.

The scores are determined by the processor by counting the pins down. If that equals 10, player #2 flag is set and the "next player" tone is sounded. If it is greater than 10, the premium multiplier is added to the score and the new score is displayed. The tone generator is set up, and the micro-processor tests various bits that control the tone generator.

The disclosed circuitry uses a pair of independent batteries. One source is used to power the micro-processor alone; while the other source powers the displays and speaker. The micro-processor requires 7.5 volts; while the displays and speakers require a lower voltage. Thus, the battery for the micro-processor can be used for the display, after its output drops below 7.5 volts.

In one preferred embodiment the micro-processor used is TMS 1000, described in the MOS/LSI ONE CHIP MICRO-COMPUTERS and other publications published by Texas Instruments. Boards 63, 64 were Texas Instrument PC 75492. The components typically had the following values:

| | |
|---|---|
| C1 | 4.7 μ fd. |
| C2 | 100 μ fd. |
| C3 | .01 μ fd. |
| C4 | 4.7 μ fd. |
| R1 | 33 ohms |
| R2 | 33 K ohms |
| R12 | 33 ohms (volume control) |
| R10 etc | 82 ohms (brightness control) |

The diodes were:

| | |
|---|---|
| D11 | IN4001 or equivalent |
| D12, D13 | IN914 or equivalent |

The bowling ball game described herein is compact and provides entertainment. The automatic scoring contains the random chance of the regular bowling game, along with the sounds associated with a regular bowling game.

While the principles of the invention have been described above in connection with specific apparatus and applications, it is to be understood that this description is made by way of example only and not as a limitation on the scope of the invention.

What is claimed is:

1. A miniaturized bowling ball game, said game comprising:

a miniaturized bowling lane assembly;

pin status means for simulating bowling pins and indicating pin status located at one end of said lane assembly;

ball means;

mechanical ball propelling means at the other end of said lane assembly for aiming and propelling said ball means the length of said lane assembly;

said ball propelling means including means for aiming said ball means at said simulated bowling pins;

zone switch means operated by said propelled ball means for determining the location of said ball means when the ball means enters the portion of the lane assembly at the said one end of said lane assembly where the pins would be;

said zone switch means comprising a plurality of downwardly extending fingers traversing said lane assembly at said one end;

each of said fingers comprising the armature of a switch momentarily closed as said ball means strikes said armature;

each of said fingers moving to an open circuit position after said ball means discontinues actuating contact with same; and said ball means and said fingers further being of relative sizes such that more than one of said switches can be closed by said ball means as said ball means passes said zone switch means;

processing means for determining which pins will be knocked down per propelled ball means responsive to said determined location and a random input for each of the pins standing when said ball means is propelled;

means in said processing means for accomodating variations in closure overlap among a plurality of said fingers struck by said ball means as it momentarily closes said fingers in a substantially simultaneous manner to assure accurate input to said processing means;

switch closure determining means in said processing means for determining the closure of said switches to thereby determine the location of said ball means; and means including said processing means for operating said pin status means to show which pins have been knocked down.

2. The miniaturized bowling ball game of claim 1 wherein said processing means includes means for fixing an odds number for each pin determinative of the number of pins being knocked down, for each pin affected by the ball means traversing the determined location.

3. The miniaturized bowling ball game of claim 2 wherein said processing means includes means for fixing the dependency of said odds on the falling of certain related pins due to the said ball means traversing the determined location.

4. The miniaturized bowling ball game of claim 3 wherein said processing means includes computing means for use in determining which of said pins will fall due to said ball means traversing said determination location, said computing means comprising means for doubling said odds, number means for adding a fixed number and a random value, means for comparing the result to a fixed value, and means for indicating said simulated pin fall if the computed number is at least equal to said fixed value.

5. The game switch means of claim 1 wherein each of said zone switch means consists of a single contact.

6. The miniaturized bowling ball game of claim 1 including frame indicator means operated responsive to signals from said processing means.

7. The miniaturized bowling ball game of claim 6 wherein said frame indicator means also provides bonus score indications operated responsive to said processing means determining that a strike or a spare was thrown.

8. The miniaturized bowling ball game of claim 7 wherein a speaker is provided operated responsive to signals from said processing means to indicate gutter balls, strikes, spares and the end of the game.

9. The miniaturized bowling ball game of claim 8 including mode switch means for selecting a one player mode or a two player mode.

* * * * *